United States Patent [19]

Oldfield et al.

[11] 4,291,936

[45] Sep. 29, 1981

[54] COAXIAL CONNECTOR WITH IMPROVED FEMALE CONDUCTOR STRUCTURE

[75] Inventors: William W. Oldfield, Redwood City; Larry J. Bier, San Jose, both of Calif.

[73] Assignee: Wiltron Company, Mountain View, Calif.

[21] Appl. No.: 81,831

[22] Filed: Oct. 4, 1979

Related U.S. Application Data

[63] Continuation-in-part of Ser. No. 904,031, May 8, 1978, abandoned.

[51] Int. Cl.[3] ..... H01R 17/18

[52] U.S. Cl. ..... 339/177 R; 339/256 R; 29/758; 29/764

[58] Field of Search ..... 339/177 R, 177 E, 143 R, 339/256 R, 258 R, 258 A

[56] References Cited

U.S. PATENT DOCUMENTS

| | | | |
|---|---|---|---|
| 3,245,027 | 4/1966 | Ziegler, Jr. | 339/89 |
| 3,332,052 | 7/1967 | Rusinyak | 339/177 R |
| 3,340,495 | 9/1967 | Weinschel | 339/177 |
| 3,845,453 | 10/1974 | Hemmer | 339/177 R |

OTHER PUBLICATIONS

Andrew; Sales Catalogue; pp. 93, 94; $\frac{7}{8}''$ Cable Components.

Transactions on Instrumentation and Measurement, p. 222, 9-1968.

*Primary Examiner*—Neil Abrams

*Attorney, Agent, or Firm*—Limbach, Limbach & Sutton

[57] ABSTRACT

An improved center conductor structure for a female member of a coaxial connector wherein a slotted pin receiving sleeve is surrounded by a cylindrical sleeve without slots. The slotted sleeve is removable, independent of all other parts, by a special tool in order to permit replacement when the sleeve becomes worn.

14 Claims, 12 Drawing Figures

COAXIAL CONNECTOR WITH IMPROVED FEMALE CONDUCTOR STRUCTURE

CROSS-REFERENCE TO RELATED APPLICATION

This application is a continuation-in-part of copending application Ser. No. 904,031, filed May 8, 1978 now abandoned.

BACKGROUND OF THE INVENTION

This invention relates generally to the art of coaxial connectors, and more specifically to an improvement in the structure of an inner conductor terminal of a female coaxial transmission line connector.

One commonly used type of coaxial connector utilizes for the inner conductor a pin as part of the male connector portion and a hollow tube as part of the female connector portion. The pin is removably placed in the tube when the connector portions are fastened together. The tube is slotted along its length beginning at its end and the resulting fingers are resiliently loaded to tightly grip the pin when inserted into the tube. A disadvantage of this type of connector is that the actual diameter of the inner conductor changes abruptly and the slots in the tube present a further effective change in diameter, all of which causes a impedance change in the cable and presents a missmatch to radio frequencies. The slots are kept as short as possible and typically are two to four in number in order to reduce the undesirable impedance missmatch but this results in contact being made with the pin at very small surface areas with a large pressure resulting between the inside of the tube and the outside of the pin. This causes excessive wear and, eventually, poor electrical contact. Furthermore, any misalignment of the mating pin and tube will cause one of the tube fingers to distort or break if the misalignment is sufficient.

The above type of connector pair is termed "sexed" and represents the overwhelming majority of connectors presently used for coaxial transmission line applications. Two other of connector arrangements are available without sexed interfacing parts.

One "sexless" interface is commonly used for high power interconnects. The inner conductors are hollow at the joint and a compressive conductive bullet is inserted into both hollow ends. Thus, the joining center conductors are smooth cylindrical surfaces without the axial slots found on the female "sexed" connector.

Another "sexless" connector pair is the General Precision Connector (GPC). In this connector arrangement, the outer conductors meet in a butt joint that is aligned and compressively held with carefully controlled tolerances by an outer coupling mechanism. The center conductors are aligned and held in the air dielectric interface by preceeding solid dielectric beads. The conductive center conductor interface is made by spring loaded extending collets located within each end section. This General Precision Connector provides repeatable connections with low interface reflection and loss that are essential high accuracy standards of measurement.

Associated with the above is the Laboratory Precision Connector (LPC) which does not include a dielectric support for the inner conductor. Two LPC's do not mate, only the LPC to a GPC joint is possible. The LPC center conductor is held and aligned by the center conductor of the GPC connector. The LPC interface does not have the supporting bead that causes reflection and, often, an upper frequency limit due to a higher order mode cavity resonance. The LPC is generally utilized in precision measurement laboratory configurations.

Since 1960 there has been a rapidly expanding use of a small and simplified connector for the increasing complex microwave system utilized in space and missile programs. The availability of miniature connectors which are mechanically rugged and low reflection has exerted a major influence on microwave circuit design in these years. Systems and components can be miniaturized with generally improved electrical performance. Miniature connectors allow packaging flexibility in both coaxial and stripline designs. The smaller size and improved performance have also opened up the frequency range of 12 to 40 GHz for coaxial circuitry.

The miniature connectors for use in the 12 to 40 GHz range, notably the SMA type, have a poor record of performance and repeatability with multiple interconnections. Measurement performance has been severely limited by the short lifetime of the miniature connector on the measurement instrument port. Often the measurement is made through an adapter between a larger, more reliable connector to the miniature connectors. Then, the adapters are frequently replaced.

Therefore, it is a principal object of this invention to provide a connector interface to the standard miniature connectors that provides low reflection, longer life and parts that subject to wear and damage are replaceable.

SUMMARY OF THE INVENTION

Briefly, the improved coaxial connector structure of the present invention utilizes an inner conductor structure of a contacting member that is submerged within a smooth sleeve that is typically cylindrical but can be prismatic or columnar. The pin of the male connector member is engaged by the inner contacting member while the outer sleeve is unslit and of a uniform diameter. The female member includes resilient means as part of the inner contacting member that firmly contacts an inserted male member. This results in eliminating the impedance discontinuity of existing connectors by making the outer shape of the inner conductor independent of the shape of the pin contacting member of the female connector.

Since the contacting conductor is within the outer sleeve, there are fewer breakage and bending problems from the pin of the male connector being misaligned with the tube. Damage due to axial misalignment when the two connectors are brought together is minimized due to flexing of the unsupported center conductor at the male or female conductor portions. The structure has improved radial strength.

The result is a coaxial connector structure that can be implemented in very small sizes and have improved high frequency performance and mechanical characteristics. A high frequency current path is provided on a smooth, unslotted outer surface of the inner conductor. Very low reflection is obtained because of this and the elimination of a bead supporting the inner contacting conductor. Thus, certain results of the high quality GPC and LPC connectors, previously discussed, are obtained.

Many particular structures for an inner contacting member can be utilized as part of the female conductor according to the present invention. One structure illustrated hereinafter is a slit tube, as used in presently available connectors, but placed within a smooth cylindrical sleeve that forms the female connector inner conductor. Since the slits of the inner tube do not affect the impedance characteristics of the connector, they can be longer than existing ones and this results in decreased wear between the tube and its mating pin. Beveled or rounded wiping edges are preferably included on the end of the slit tube fingers in order to further reduce wear from repeated connecting and disconnecting. Rounded edges of the fingers reduce wear from rotation of the male connector pin that occurs therein.

Additionally, at least the inner conductor is preferably made removable from the conductor structure so it can be replaced if it becomes worn out or damaged, such replacement being possible with restoration of the original high frequency and other electrical and mechanical characteristics of the connector. Additionally, this structure permits the inner female conductor to be assembled last, thus enabling precise dimensional control. The outer female member sleeve can be made removable with similar advantages. This structure further allows precise setting of the female connector pin depth. The male connector pin may also be removably attached to its conductor with similar advantages.

Additional objects, advantages and features of the present invention will become apparent from the following description of its preferred embodiments which should be taken in conjunction with the accompanying drawings.

DESCRIPTION OF THE PREFERRED EMBODIMENTS

Figure 1A:
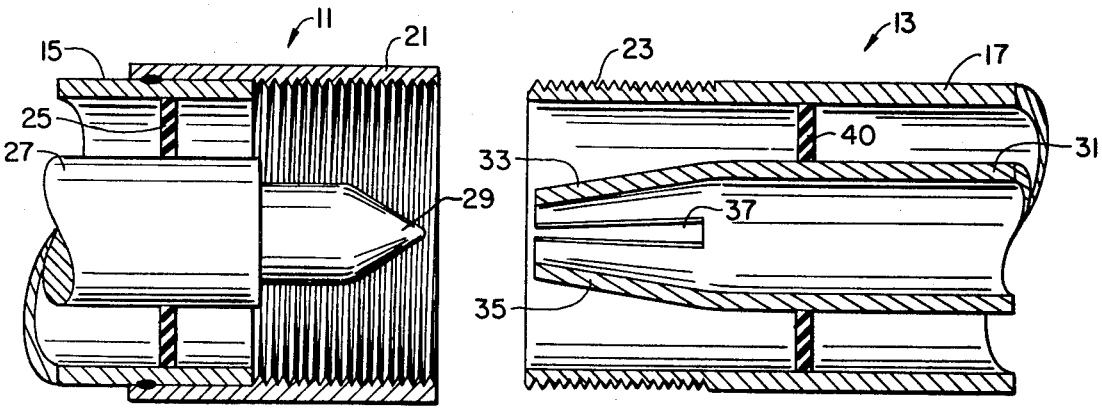
FIG. 1A. PRIOR ART
FIG. 1A illustrates in side sectional view an existing connector of the type over which the present invention is an improvement.
Figure 1C:
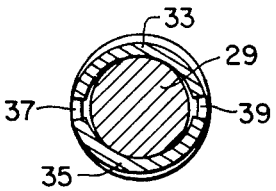
PRIOR ART FIG. 1C.
FIG. 1C is a section of the connection of FIG. 1B taken at section 1C—1C.
Figure 1B:
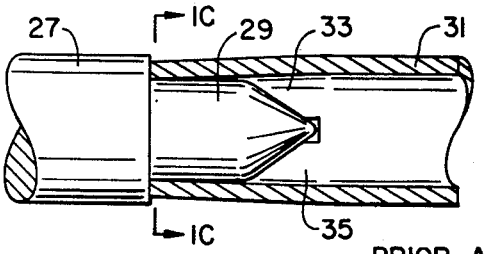
FIG. 1B. PRIOR ART
FIG. 1B shows a portion of the elements of FIG. 1A after being connected together.

Referring to FIG. 1, an existing prior art structure will first be described. A male coaxial conductor 11 and a female coaxial conductor 13 having outer conductor portions indicated schematically at 15 and 17, respectively. An internally threaded sleeve 21 is held to be rotatable with respect to the cable structure of the connector 11 and mates with the external threads 23 of the connector 13.

Held coaxially within the outer conductor 15 by either a solid insulating material, or beads 25 in the case where an air dielectric is used, is a solid inner conductor 27. The conductor 27 terminates in a pin 29 that has a maximum diameter that is something less than the diameter of the conductor 27. The female connector 13 has a hollow inner conductor tube 31 usually formed by making a hole in one end of a solid inner conductor. The tube 31 is formed at its other end into two fingers 33 and 35 by slots 37 and 39. The tube 31 is held within the outer conductor 17 by a solid insulating material or beads 40 in the case where an air dielectric is used.

The inner diameter of the tube 31 is made to be larger than the outer diameter of the pin 29 for easy insertion therein. The fingers 33 and 35 are bent inwards so that the opening into which the pin 29 inserts is smaller than the outside diameter of the pin 29. The fingers 33 and 35 are forced apart when the pin 29 makes contact, thus providing a firm mechanical and electrical contact between the two inner conductors.

As mentioned previously, the slots 37 and 39 cause an impedance discontinuity at the conductors since they change the effective diameter of the inner conductor. Furthermore, as can be seen from FIG. 1B, there is a discontinuity in the actual diameter between the conductor 27 and the outside of the tube or sleeve 31. As is well known, a change in the actual or apparent diameter of the inner conductor will change the impedance of the coaxial cable, absent some compensation. It is usually desired or required that the impedance of a coaxial cable be uniform along its length, so such a discontinuity is highly desired.

Figure 2C:
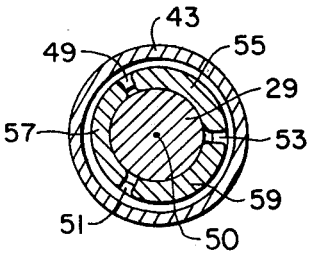
FIG. 2C is a sectional view of the connector of FIG. 2B taken at section 2C—2C thereof.

Referring to FIG. 2, an improved structure for the end of an inner conductor 41 is illustrated as a substitution for the tube 31 of FIG. 1 in the female connector 13. An outer tube or sleeve 43 has an inside diameter very slightly less than that of a reduced diameter portion 61 of the conductor 41 as its end. The sleeve 43 is cylindrical in shape with a substantially smooth, nonslotted outside surface. The outside diameter of the sleeve 43 is equal to that of the conductor 41, which in turn are both equal to that of the conductor 27 for air dielectric interfaces. For an air to solid dielectric interface, diameters of the elements 43 and 27 can be different, the electrical discontinuity being compensated by means which are well known. An inner tube 45 is held at its inside end substantially coaxial with the sleeve 43 and conductor 41 by an externally threaded screw or stud 47. The screw 47 is threaded into an end of the conductor 41 coextensive with the reduced diameter portion 61. The tubes 43 and 45 are independently mounted at one end to the conductor 41 with a space between them around their circumferences. No other support is provided.

Slots 49, 51 and 53 running along the length of the tube 45 form three fingers 55, 57 and 59. These slots in the embodiment of FIG.2 are made much longer than the slots of the embodiment 37 since because of the uniform diameter outer tube 43, the impedance of the connector is not disturbed by these slots. The lengths of the fingers 55, 57 and 59 are substantially equal, more than four times the internal diameter of the inner tube 45 at its male pin receiving end. The tube 45 has an inside diameter greater than that of the pin 29 but the fingers 55, 57 and 59 form an opening at their free, unattached ends that is somewhat smaller than the diameter of the pin 29. When the pin is inserted therein, as shown in FIG. 2B, a positive mechanical and electrical connection is thus established through the resiliency of the fingers 55, 57 and 59.

Because the spring force of the fingers 55, 57 and 59 is less than the embodiment of FIG. 2 than it is in the prior art as described with respect to FIG. 1, the fingers 55, 57 and 59 are not likely to deform, wear or break as easily. With extensive use or upon damage, however, it may be desired to replace the inner tube 45 and this can be done by unthreading it from its threaded connection with the conductor 41 and replacing it with a new inner tube. This replacement of the tube 45 will not change the impedance characteristics of the connector and may be done without removing the sleeve 43 in a manner described hereinafter with respect to FIGS. 5 and 6. The sleeve 43 is, however, independently removable in a manner described hereinafter with respect to FIG. 7. Additionally, the male connector portion pin 29 may be removably held by the conductor 27 through appropriate threads or a press fit 28.

In order to reduce connector wear and to make it easier to insert and remove the pin 29 from the end of the inner conductor and the female connector, the fingers 55, 57 and 59 are each provided with wipers on the ends thereof. The structure of these wipers can easily be seen by referring to the view of a wiper 61 at the end of the fingers 55 of FIG. 2A. These wipers form a reduced diameter entrance aperture to receive the pin 29. Both forward and rear edges thereof are beveled, as shown, or may be rounded for easy insertion and removal of the pin 29 therefrom and to reduce wear. The edges of the fingers 55, 57 and 59 are also rounded by chemical etching or some other technique in order to reduce wear, particularly as the pin 29 is rotated in the sleeve 45.

Figure 4:
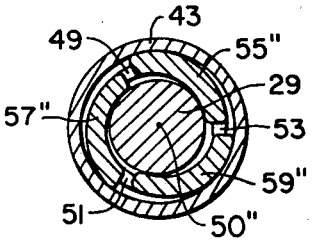
FIG. 4 illustrates a possible modification of the previously illustrated embodiments as an exemplary variation of the view of FIG. 2C.

Under some conditions and at some radio frequencies, the space between the sleeves 43 and 45 may act as a circuit component and undesirably affect the signal being transmitted through the cable. This cavity may be shorted out if this ever becomes a problem. One way of shorting it out is shown in FIG. 4 which shows the structure of the connector to be the same as that in FIG. 2C except that its fingers 55'', 57'' and 59'' are twisted versions of the fingers 55, 57 and 59, respectively. The fingers 55'', 57'' and 59'' all contact the pin 29 and the outer sleeve 43. Another technique for accomplishing this is to form the fingers into a waving shape along their length to contact both the inside surface of the outer sleeve 43 and the outside surface of the pin 29.

Figure 2A:
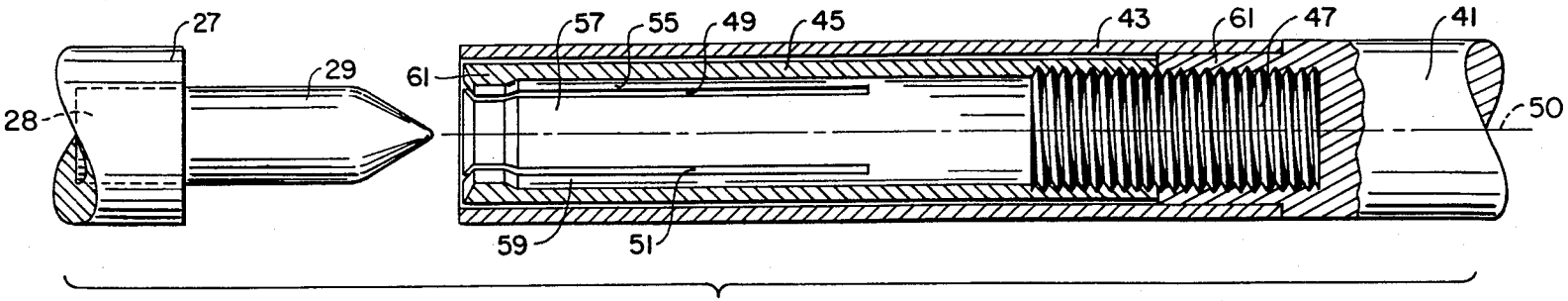
FIG. 2A shows an improved inner conductor connector according to one embodiment of the present invention, wherein the female conductor member is shown cut away.
Figure 2B:
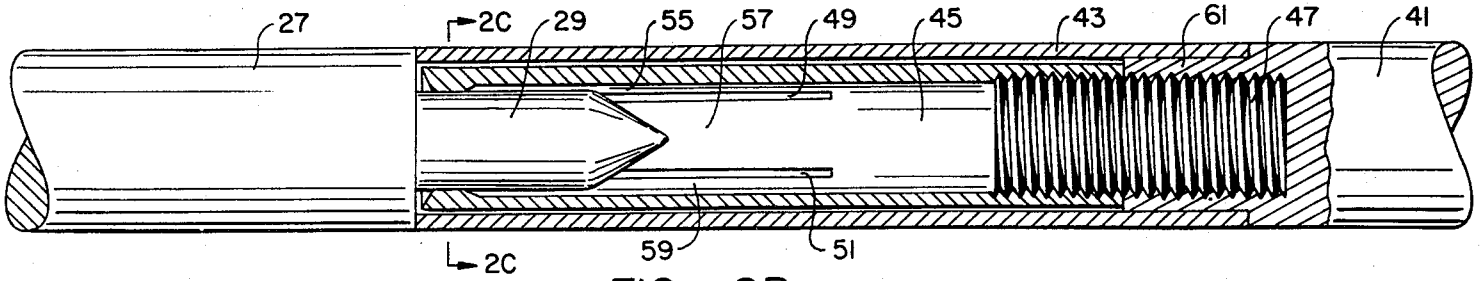
FIG. 2B shows the connector of FIG. 2A with its parts connected together.
Figure 3:
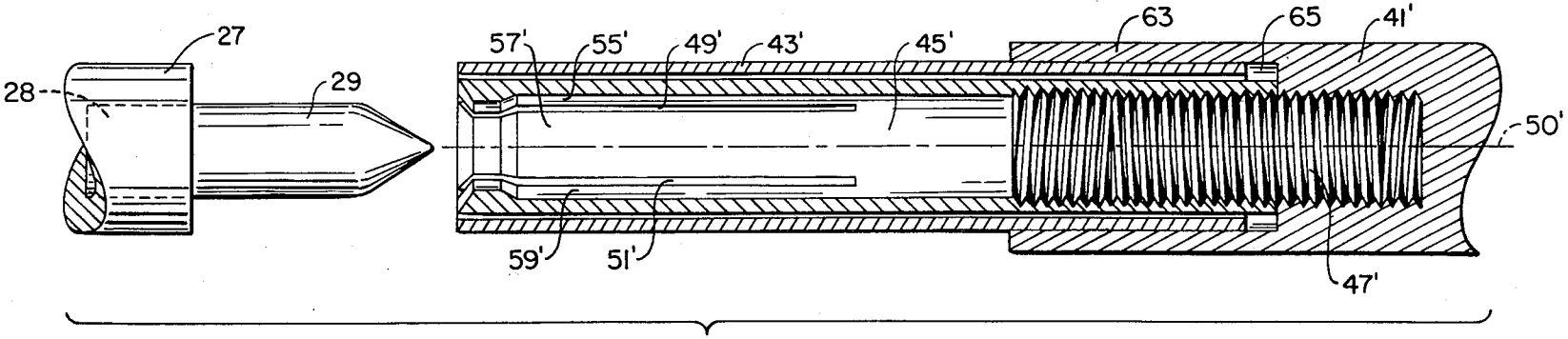
FIG. 3 shows an inner conductor structure according to another embodiment of the present invention wherein the female conductor portion is shown cut away.

Referring to FIG. 3, another embodiment of the improved connector according to the present invention is shown wherein similar parts to those of the embodiment of FIG. 2 are given the same reference number with a prime (') added. The principal difference between the connector of FIG. 3 and that of FIG. 2 is the way in which the outer sleeve 43' is attached to the conductor 41'. In the embodiment of FIG. 3, a conductor 41' has a hole 65 drilled in its end into which the sleeve 43' is force fit to be held thereby. The sleeve 43' has an outside diameter that is less than that of the conductor 41 by approximately twice the thickness of a resulting conductor shell 63 and only slightly greater than the inside diameter of the hole 65 in order to provide a tight fit. Compensation for a discontinuity in the outside diameter of the inner conductor of FIG. 3 may be accomplished by either changing the dielectric material at that point or changing the diameter of the outer coaxial conductor, as is well known.

All of the connector elements of FIGS. 2A, 2B and 3 are round in cross-section with a center about which they are symetrical being a center axis 50 (FIGS. 2A and 2B) or 50' (FIG. 3). Many variations in the specific shape of these elements are, of course, for example, the inside tube 45 may be made some other shape than round, such as square. Even its slots 49 can be eliminated if its walls or some other structure provide the resiliency necessary to firmly contact the pin 29. The tube 45 can even be eliminated altogether and replaced by some other structure within the sleeve 43 that forms a firm electrical contact with the male pin 29. The outer sleeve 43 does not even have to be round in cross-section, although this is typical of coaxial cables and connectors.

An advantage of the connector structure described above is that it can be made very small. A commercially useable small size has an outside diameter of the solid sleeve 43 (FIGS. 2A and 2B) less than 1.6 millimeter in diameter.

The connector portions according to the present invention shown in FIGS. 2A, 2B and 3 are held within an outer conductor in a manner shown generally in FIG. 1A. The inner conductor supporting beads 25 and 40 (FIG. 1A) that would similarly hold the conductors of FIGS. 2A, 2B and 3 are positioned a distance back from the ends of the respective conductor interconnection portion shown in order to provide some radial flexibility to properly mate misaligned inner-conductor portions and to reduce energy reflection losses. The closest bead to the free end of the female inner-conductor of FIGS. 2A, 2B and 3 is preferably a distance along the conductor 41 to the right of the right-hand extreme edge of the sleeve 43 that is at least five times the diameter of the conductor 41 in the general case and 15 times that diameter in special circumstances.

Figure 5:
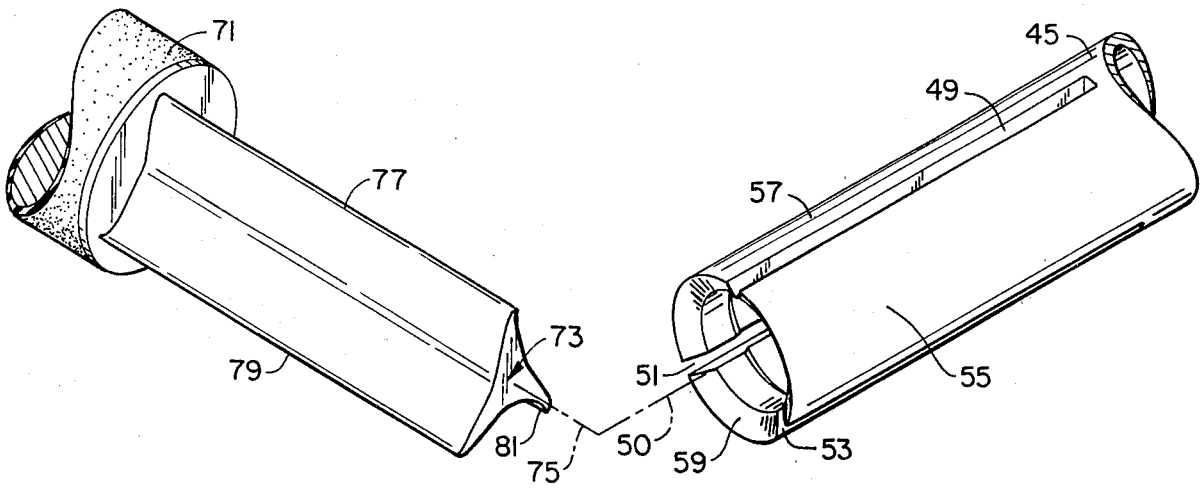
FIGS. 5 and 6 show a tool and its use for removing or installing one female connector portion.
Figure 6:
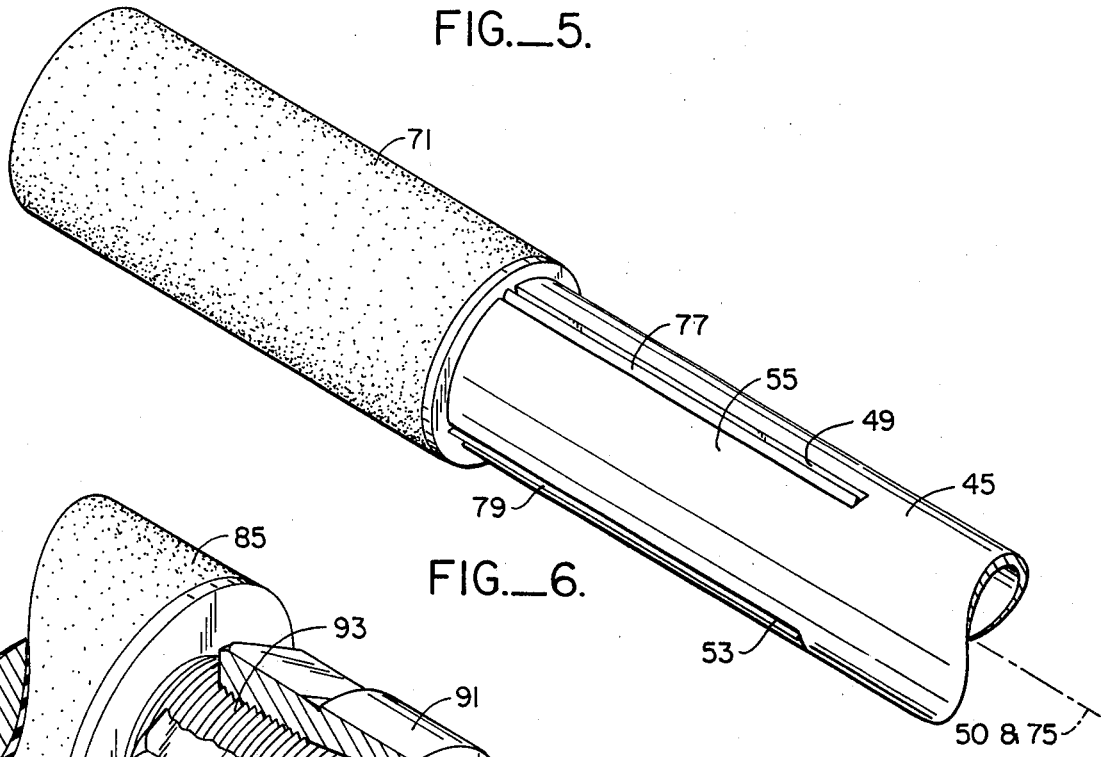

Referring to FIGS. 5 and 6, the use of a special tool to remove the slotted sleeve 45 of FIGS. 2A and 2B without disturbing the sleeve 43 is illustrated. The tool has a handle 71 that is roughened for gripping by the fingers. Attached to the handle is a tube contacting tool portion 73 that is symmetrical in cross-section about an axis 75. The tool is shaped to have three blades 77, 79 and 81 extending along the length of the tool portion 73 and angularly displaced with respect to one another about the axis 75. The cross-sectional shape of the tool portion 73 is substantially uniform along its length. The blades 77, 79 and 81 are angularly displaced to correspond to the angular displacement of the slots 49, 51 and 53 of the tube 45 in order to fit in them when the tool portion 73 is positioned within the tube 43. The cross-sectional shape of the tool 73 is, of course, made to mate with the interior of the tube 45 for easy insertion and removal. When inserted, as shown in FIG. 6, the tube 45 may be threaded or unthreaded to the threaded stud 47 (FIG. 2A) within the sleeve 43 by rotation of the handle portion 71 between fingers.

Figure 7:
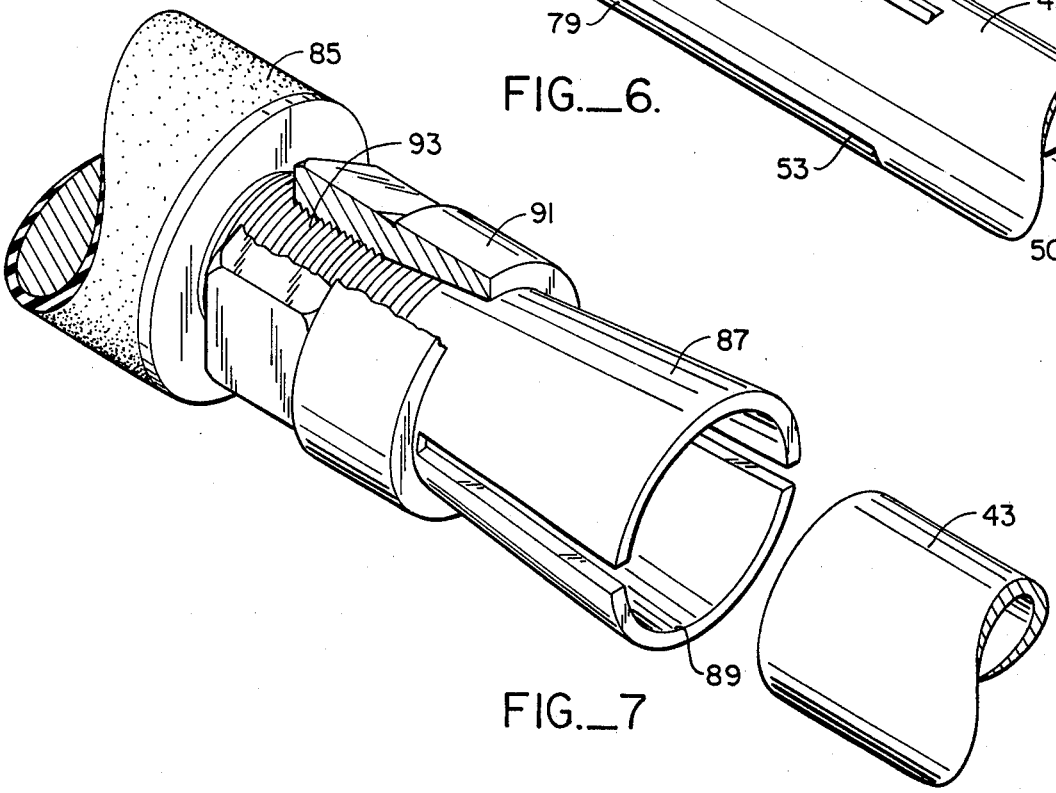
FIG. 7 shows another tool and its use for removing or installing another female connector portion.

Referring to FIG. 7, another tool is illustrated for removing the sleeve 43 of FIGS. 2A and 2B from the conductor 41. It similarly operates to remove the sleeve 43' from the conductor 41' of FIG. 3. The tool of FIG. 7 is designed to clamp around the outside of the tube 43 to permit it to be pulled away from the conductor 41, or to be pushed onto the conductor 41, as the case may be. The tool of FIG. 7 has a handle 85 roughened for gripping between the fingers of a user. At the other end is an outwardly flaring tube portion formed of segments 87 and 89. A circular member 91 is carried by threads 93. When the segment 91 is rotated in a manner to move it outward away from the handle 85, the segments 87 and 89 are caused to come together and tightly grip the tube 43. When the removal or installation of the tube 43 is completed, the threaded cylindrical piece 91 is rotated in a manner to move back towards the handle 85 to release the grip of the segments 87 and 89 on the sleeve 43. The same tool can be used for removal and insertion of the male pin 29 if attached to the conductor 27 by force fitting.

Figure 8:
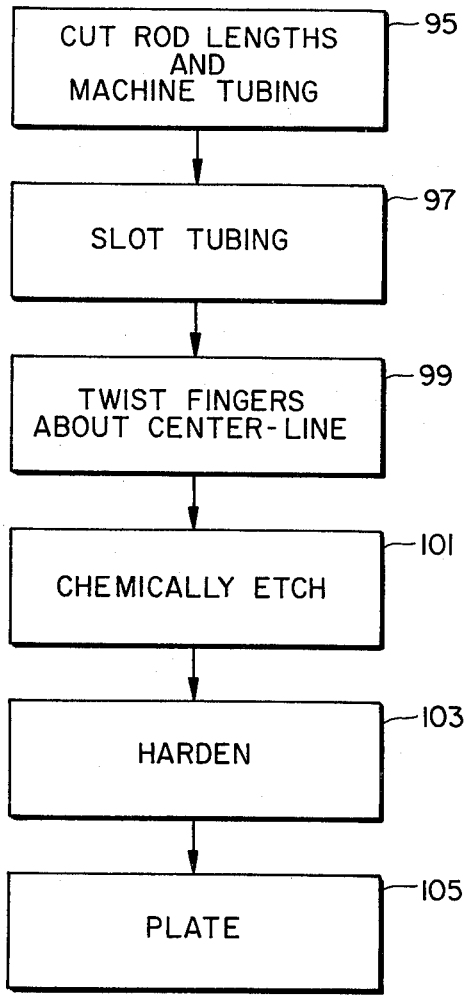
FIG. 8 outlines the manufacturing steps for the slotted inner conductor of the embodiments of FIGS. 2 and 3.

Referring to FIG. 8, the manufacturing steps for the slotted inner-tubes 45 and 45' (FIGS. 2A, 2B and 3) is outlined. Because of the small dimensions and close tolerances involved, each of these slotted sleeves is made from a solid rod material. The first step 95 is to cut the rod into the length of the desired finished tube 45 and then to drill out its center. A connical drill is utilized from each end of the tube in order that the inward projecting bevel 61 remains. The next step 97 is to form slots 49, 51 and 53 along the length of the tube. The next step 99 is to twist the resulting fingers 55, 57 and 59 around the axis 50, if desired to result in the structure illustrated in FIG. 4.

The next step is to dip the slotted tube into an acid bath in order to round off the cut edges. This results in a structure that wears down a mating pin less since the sharp edges have been removed. Only the fingers need to be immersed in the acid bath but it is usually more convenient to immerse the whole tube.

The next step 103 is to harden the tube by heating in an oven for a specified time at a given temperature and then cooled. The final step 105 is to plate the slotted tube. The basic rod material utilzed in making the tube is preferably stainless steel or beryllium copper. With these materials, a high density silver plate is preferably applied as a last step 105. This is applied by dipping the slotted tube into a bath to chemically plate it, in a preferred form, rather than electrically plating it.

The various aspects of the present invention have been described with respect to their preferred embodiments, but it will be understood that the invention is entitled to protection within the full scope of the appended claims.

We claim:

1. A precision connector for mechanically and electrically joining two ends of a coaxial circuit configuration, each characterized by an inner conductor positioned within an outer conductive shield surrounding the inner conductor, comprising:

a male connector portion attached to one of said coaxial circuit ends, said male portion comprising:

an electrically conductive pin attached at one end to an end of the inner conductor, said pin having a diameter significantly less than a diameter of said inner conductor end and having its other end formed into a point-like shape, and an outer conductor connector portion attached to the outer conductor of said one coaxial circuit end, said outer connector portion surrounding said inner conductor pin without making electrical contact therewith, and a female connector portion attached to the other of said coaxial circuit ends, said female portion comprising:

a tube-like electrically conductive member removably attached at one end to the inner conductor and another end remaining free to receive said pin therein when the male and female connector portions are joined, said member having a plurality of slots extending along its length a distance from its free end toward said one end, thereby to form a plurality of fingers having a radial spring characteristic, an opening of said member at said free end being slightly less in diameter than the diameter of said pin, thereby firmly contacting and gripping said pin when inserted in said free end opening, said tube-like member having beveled edges at its said another end in a manner that its leading edges are sloped from the outside surface to the inside surface in a direction toward said one end, and all edges of said fingers are rounded, thereby making insertion, rotation and removal of the pin therein with reduced wear, a cylindrically shaped electrically conductive sleeve attached at one end to said inner conductor independent of the attachment of said one end of the tube-like member thereto and held free at its other end, said sleeve being characterized by having an outer diameter substantially equal to that of the inner conductor of the male connector portion and an inner diameter greater than an outer diameter of said tube-like member and a non-perforated outside surface, whereby no outside inner conductor surface irregularities exist when the male and female connector portions are connected together, and an outer conductor connector portion attached to the outer conductor of said another coaxial circuit end, said outer connector portion surrounding said sleeve and having a mating configuration with the outer conductor connector portion of said male connector.

2. The connector according to claim 1 wherein said tube-like member of the female connector portion additionally comprises on its inside immediately alongside said another end a raised wiper surface at the end of each finger, the raised surface being beveled at either side thereof along its length.

3. The connector according to claim 1 wherein the tube-like member of the female connector portion is internally threaded at its said one end, and further wherein said female connector additionally comprises a threaded stud with a mating internally threaded aperture in an end of the inner conductor and adapted to threadedly engage the threaded portion of the tube-like member, whereby said member may be removed from the connector for replacement by rotation with an appropriate tool.

4. The connector according to claim 3 wherein said sleeve is removably attached to said inner conductor by a force fit at its said one end.

5. The connector according to claim 1 wherein the length of the slots in said tube-like member are more than four times its internal diameter at said another end, whereby the fingers flex over small distances as a male connector pin is inserted therein and the life of the fingers is increased.

6. The connector according to claim 1 wherein said female connector portion inner conductor sleeve is less than 1.6 millimeters in diameter.

7. The connector according to claim 1 wherein said male connector pin is removably attached to the end of the inner conductor, whereby said pin is removable for replacement when it becomes worn.

8. A precision connector for mechanically and electrically joining two ends of a coaxial circuit configuration, each characterized by an inner conductor positioned within an outer conductive shield surrounding the inner conductor, comprising:

a male connector portion attached to one of said coaxial circuit ends, said male portion comprising:

an electrically conductive pin attached at one end to an end of the inner conductor, said pin having a diameter significantly less than a diameter of said inner conductor end and having its other end formed into a point-like shape, and an outer conductor connector portion attached to the outer conductor of said one coaxial circuit end, said outer connector portion surrounding said inner conductor pin without making electrical contact therewith, and a female connector portion attached to the other of said coaxial circuit ends, said female portion comprising:

a tube-like electrically conductive member removably attached at one end to an inner conductor end and another end remaining free to receive said pin therein when the male and female connector portions are joined, said member having a plurality of slots extending along its length a distance from its free end toward said one end, thereby to form a plurality of fingers having a radial spring characteristic, an opening of said member at said free end being slightly less in diameter than the diameter of said pin, thereby firmly contacting and gripping said pin when inserted in said free end opening, said tube-like member having beveled edges at its said another end in a manner that its leading edges are sloped from the outside surface to the inside surface in a direction toward said one end, thereby making insertion and removal of the pin therein with reduced wear, said member being internally threaded at its said one end for attachment to an externally threaded stud that is attached to said inner conductor end thereby forming the removable attachment of said tube-like member to the inner conductor, a cylindrically shaped electrically conductive sleeve attached at one end to said inner conductor independent of the attachment of said one end of the tube-like member thereto and held free at its other end, said sleeve being characterized by having an outer diameter substantially equal to that of the inner conductor of the male connector portion and an inner diameter greater than an outer diameter of said tube-like member and a non-perforated outside surface, whereby no outside inner conductor surface irregularities exist when the male and female connector portions are connected together, and an outer conductor connector portion attached to the outer conductor of said another coaxial circuit end, said outer connector portion surrounding said sleeve and having a mating configuration with the outer conductor connector portion of said male connector.

9. The connector according to claim 8 wherein said tube-like member of the female connector portion additionally comprises on its inside immediately alongside said another end a raised wiper surface at the end of each finger, the raised surface being beveled at either side thereof along its length.

10. The connector according to claim 8 wherein said sleeve is removably attached to the end of the inner conductor, whereby said pin is removable for replacement when it becomes worn.

11. The connector according to claim 8 wherein said sleeve is removably attached to said inner conductor by a force fit at its said one end.

12. The connector according to claim 11 wherein an inside surface of said sleeve at its said one end is attached to an outside surface at the inner conductor along a length having a diameter reduced by twice the thickness of said sleeve, whereby the outside sleeve surface and inner conductor outside surface are joined with substantially no discontinuity therebetween.

13. The connector according to claim 11 wherein the end of the inner conductor within the female connector portion includes a cylindrical hole extending a distance therein with a radius slightly smaller than the radius of the outside surface of said sleeve at said one end, whereby said sleeve is held within said hole, said threaded stud being attached to the inner conductor within the sleeve at a termination of the hole therein.

14. The connector according to any of claim 1 through 13, inclusive, wherein the fingers of said tube-like member of the female connector portion are twisted in a manner that at least a portion of the length of one edge of each finger along one of said slots contacts the inner surface of said sleeve and at least a portion of the length of an opposite edge of each finger extends inward of said tube-like member.

* * * * *